US005300193A

United States Patent [19]

Rule, Jr. et al.

[11] Patent Number: 5,300,193

[45] Date of Patent: Apr. 5, 1994

[54] METHOD FOR PAPER MACHINE STOCK POND CONSISTENCY CONTROL

[75] Inventors: James A. Rule, Jr., Clifton Forge, Va.; Jeffery S. Sanford, Charleston; Allen C. Wall, Goose Creek, both of S.C.

[73] Assignee: Westvaco Corporation, New York, N.Y.

[21] Appl. No.: 13,495

[22] Filed: Jan. 28, 1993

Related U.S. Application Data

[63] Continuation of Ser. No. 641,539, Jan. 15, 1991, abandoned.

[51] Int. Cl.[5] ..... D21C 1/08; D21C 7/06

[52] U.S. Cl. ..... 162/198; 162/258

[58] Field of Search ..... 162/252, 253, 250, 263, 162/49, 198, DIG. 11, 208, 314, 61, 210

[56] References Cited

U.S. PATENT DOCUMENTS

| | | | |
|---|---|---|---|
| 2,922,475 | 1/1960 | Alexander | 162/252 |
| 4,145,249 | 3/1979 | Hansen | 162/314 |
| 5,026,455 | 6/1991 | Lehtikoski et al. | 162/49 |

OTHER PUBLICATIONS

NDC Model 104–Mass Measurement Gage User Manual, NDC Systems, 730 East Cypress, Monrovia, Calif. 91016, rev. 2566, Dec. 12, 1988.

TAPPI Standard TIS 014-7-"Evaluating the drainage performance of a fourdrinier," rev. 1988.

*Primary Examiner*—Steve Alvo

*Attorney, Agent, or Firm*—J. R. McDaniel; W. A. Marcontell; R. L. Schmalz

[57] ABSTRACT

Papermachine stock consistency is regulated while carried along a forming wire table. A variable draft vacuum box disposed beneath the forming wire to draw water from the wire carried stock is automatically adjusted in response to the summation of signals from several sources. A radioactive mass measuring gauge having a sensor head positioned beneath the forming wire downstream of the vacuum box provides a signal value indicative of the total mass carried above the sensor head. From this mass measuring gauge signal is deducted a value representative of the wire mass; the remainder representing the stock mass comprising a mixture of fiber and water. The quantity of fiber in the stock mixture, independent of the water, is determined by a dry basis weight measure of paper made from the stock. A signal value representative of the fiber basis weight is divided by the stock mass signal value to yield a consistency signal value. The consistency signal value is compared to a set-point signal value for determination of a vacuum box control signal.

5 Claims, 1 Drawing Sheet

METHOD FOR PAPER MACHINE STOCK POND CONSISTENCY CONTROL

This is a continuation of copending application Ser. No. 07/641,539 filed on Jan. 15, 1991, now abandoned.

BACKGROUND OF THE INVENTION

1. Field of the Invention

The present invention relates to the art of Fourdrinier papermaking. More specifically, the present invention relates to consistency control of the papermaking stock pond carried by a papermachine forming wire between the headbox and the couch roll.

2. Description of the Prior Art

The term "consistency" or "stock consistency" is used in the papermaking art to describe the relative fiber content in a given stock quantity. Thus, an increase in consistency of the pulp stock indicates a relative increase in the dry, wood fiber constituent of a slurried, fiber-in-water suspension.

Typically, Fourdrinier papermaking stock flows as a 0.5% to 2% consistency fluid jet from a headbox slice opening onto the upper surface of a moving, endless screen belt characterized as a Fourdrinier wire or fabric. This wire or Fabric, which is made from woven metal or plastic strands, is supported by a breast roll and a couch roll, the breast roll being located adjacent the headbox at one end of what is referred to as the forming section of the papermachine. Between the breast roll and the couch roll, the wire is supported by a multiplicity of table rolls and/or foils, and passes over suction boxes in its travel from the breast roll to the couch roll, each of these items being situated beneath an upper run of the wire at locations spaced between the breast and couch rolls. As the wire travels from the breast roll to the couch roll, water is drawn through the wire from a "pond" of wire supported pulp stock leaving a thin web formation of self-supporting, matted fibers on the upper surface of the wire. This web of matted fibers, still containing a considerable quantity of water, is lifted from the wire at the couch roll. After passing around the couch roll, the wire course returns through a series of return rolls to the upstream end of the forming section of the papermachine, where it passes around the breast roll and directly under the headbox to complete its path of travel.

At the end of the papermachine forming section, the proportion of fibers and solids in the wet, wire carried web is generally in the order of 15% to 22%. Here, the wet web of paper is peeled from the wire and guided into the papermachine pressing and drying sections wherein most of the remaining water is removed.

The rate at which water is removed from the pond is critical to the runnability of the papermachine and to the quality of paper produced. If the consistency is not sufficiently high by the end of the machine forming section, the fragile web will separate at the leap from the couch into the press section thereby disrupting the web production continuity. On the other hand, if the pond consistency is too high at the point of engaging top forming appliances such as a dandy roll or shear roll, such appliances are ineffective.

The prior art has manually judged pond consistency and, hence, pond drainage rate, by the physical location of a visually discernable "dry line" whereat the pond loses its light reflective surface sheen. At this point, the pond consistency is about 11% to 12%. Movement of the dry line up or down the machine direction signifies an exponential change in the pond drainage rate. Control over the dry line location has been asserted by manual adjustment of table suction boxes.

Due to many and complex reasons originating in the pulp mill, stock preparation and even in the raw wood supply, drainage characteristics of the pulp stock are continuously but irregularly changing. Consequently, pond consistency upstream of the dry line may vary by 100% at any given point over an interval of 30 minutes. These consistency variations are not manually perceptible to the papermachine tender but have dramatic influence over the effectiveness of top forming appliances.

It is an objective of the present invention, therefore, to provide a method and means for on-line consistency measurement of papermachine pond stock along the machine table.

Another object of the present invention is to provide a method and means for stabilizing the papermachine table pond drainage rate.

Another object of the present invention is to provide a method and means for regulating draft of Fourdrinier table suction boxes in response to stock pond consistency variations.

Another object of the present invention is to control papermachine stock pond consistency upon approach to a top forming appliance.

Another object of the present invention is to stabilize papermachine stock pond consistency at the couch roll.

SUMMARY OF THE INVENTION

These and other objects of the invention are served by a control system which employs a radioactive mass measurement gauge for pond stock consistency measurement. Such a gauge includes a remotely positioned emitter/sensor head which is secured beneath but closely adjacent to the top run of the Fourdrinier wire. This mass measurement gauge emits a signal proportional to the total mass proximately above the sensor head. Such total mass normally comprises the sum of the Fourdrinier wire mass and the stock mass. The stock mass is the sum of the fiber and water stock constituents. The unit or basis weight of dry paper produced from the stock mass is the fiber mass, individually.

From the total mass signal is deducted a constant signal value proportional to the wire mass; the remainder being a signal value representing the stock mass. This stock mass signal is processed as the divisor with a product basis weight signal to derive a quotient proportional to the stock consistency.

The product basis weight signal may be a constant based upon an average production continuum or a variable emitted by a reel basis weight gauge.

A resulting stock consistency signal is compared to a set-point value representative of the stock consistency desired at the mass measurement gauge sensor head. Differential values produced by the comparison are used to regulate the degree of vacuum drawn by a suction box beneath the Fourdrinier wire and upstream of the sensor head.

BRIEF DESCRIPTION OF THE DRAWINGS

Relative to the drawings wherein like reference characters designate like or similar elements throughout the drawing figures.

DESCRIPTION OF THE PREFERRED EMBODIMENTS

Figure 1:
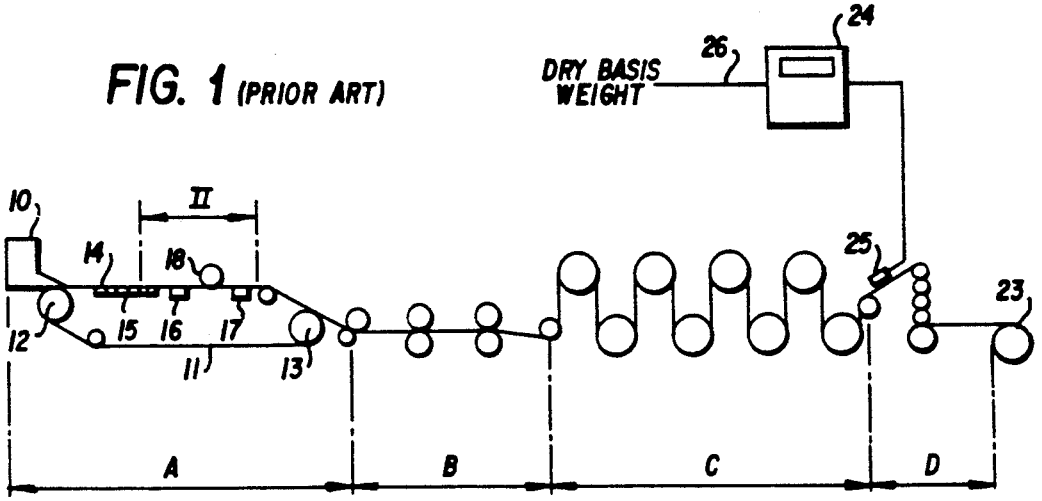
FIG. 1 (PRIOR ART)
FIG. 1 illustrates, in line schematic format, a prior art Fourdrinier papermachine for delineation of the present invention operational region.

Traditional Fourdrinier papermachine layout as illustrated by FIG. 1 comprises a wet forming section A, a wet press section B, one or more drying sections C and, optionally, a calendar Section D.

Major constituents of a wet forming section A include a headbox 10 for jetting a fluid slice stream of papermaking stock onto the upper table surface 14 of an endless belt screen 11 characterized by the art lexicon as a forming wire or, simply, "wire." A powered breast roll 12 drives the wire 11 around a closed loop between the breast roll 12 and a couch roll 13.

Structural support for the table surface 14 plane is provided by a multiplicity of foil slats 15 and suction boxes 16, Depending on the desired paper product specifications, a top forming roll 18 may be used in light contact with the upper surface of the stock pond 20. Used in conjunction with a top forming roll are one or more low vacuum suction boxes 16 upstream of the top roll and one or more high vacuum suction boxes 17 placed under the forming wire downstream of the top roll. Vacuum draft from the suction boxes is drawn from respective vacuum headers 19 via vacuum connection pipes 21. A control valve 22 regulates the rate of vacuum draft through the suction box 16.

At the dry end of the machine near the product reel 23 and downstream of the drying section C, dry basis weight of the finished web is frequently measured with a basis weight gauge 24 having a transversely scanning sensor head 25. A signal representation of the measured basis weight value is transmitted over conduit 26 to a value recorder or analog display.

Figure 2:
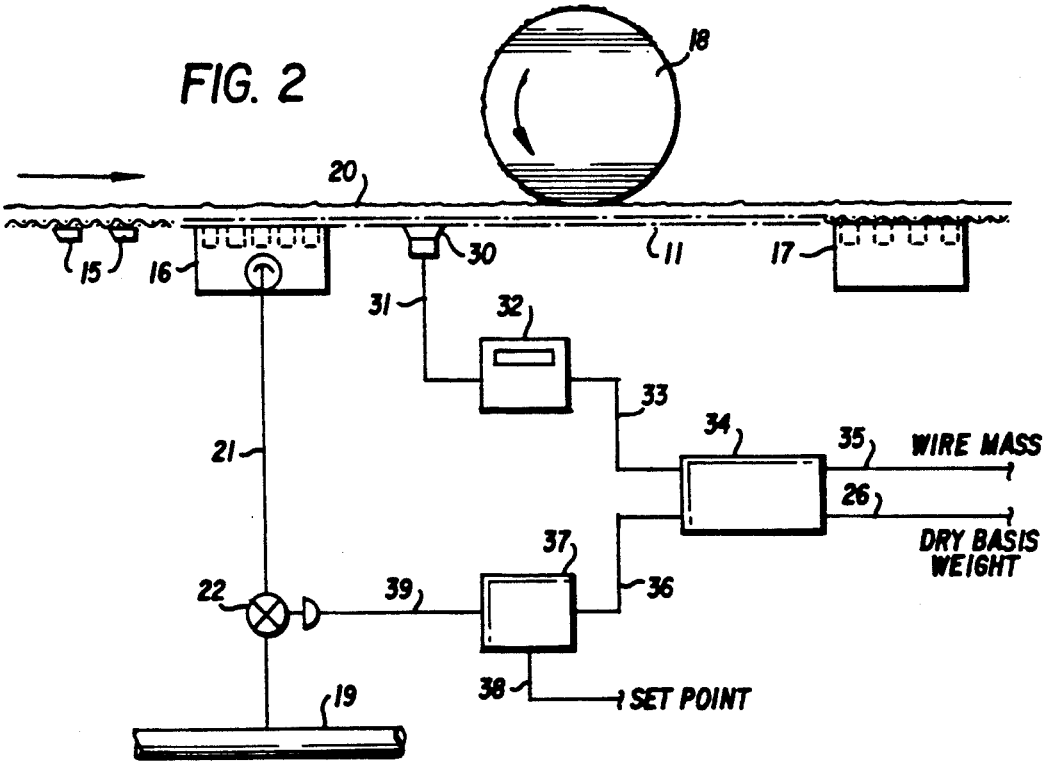
FIG. 2 is a line schematic of the present invention applicable to the Detail II region of FIG. 1.

The present invention is appropriately applied in that portion of wet forming section delineated by the Detail II of FIG. 1. The FIG. 2 enlargement of this Detail II provides a stationary or transversely scanning radioactive emitter/sensor head 30 located beneath the forming wire 11 between the low vacuum suction box 16 and the top forming roll 18. Signal conductor 31 connects the emitter/sensor head 30 with a matched signal processing unit 32 for production of a total mass signal value carried by conductor 33 to a signal processing console 34.

Collectively, the emitter/sensor head 30, signal processing unit 32, and connecting conductor 31 constitutes a mass measurement gauge. A low yield gamma ray emission source guided through a shielded collimator is located within the head 30. Backscatter gamma energy is received by a detection crystal also located in the sensor head 30. Radiation from the emission source strikes the wire 11 and wire supported stock pond 20. Some of this radiation passes through the wire 11 and stock pond 20 masses, some is absorbed and the remainder is reflected as photon backscatter. The greater the target mass, the more photons are back scattered. Each photon hitting the crystal produces a flash of light. The intensity of this flash is directly proportional to the energy of the crystal absorbed photon. Optically coupled to the crystal is a photo multiplier which converts the flashes to electrical pulses with pulse height proportional to the light flash intensity.

A specific example of such an instrument is an NDC Model 104 Mass Measurement Gauge manufactured by NDC Systems, 730 East Cypress, Monrovia, Calif.

Signal processing console 34 is also provided by input channel 35 with a signal or input data proportional to the mass of wire 11 independent of the stock pond 20. Since the mass of wire 11 is of constant value, variability of the total mass signal carried by conductor 33 is attributed exclusively to the stock pond 20.

Data input to the signal processing console 34 from channel 26 representing the dry product basis weight further distinguishes the dry fiber weight in the stock pond from the water therewith.

The resulting signal output of signal processing console 34 carried by conductor 36 represents the stock pond 20 consistency if processed by the relation of:

$$\text{consistency} = \text{dry basis weight} \div (\text{total mass} - \text{wire mass})$$

Such consistency signal becomes the input variable to valve controller 37 which compares the momentary consistency value to a fixed value set-point provided by input channel 38. A control strategy program within the valve controller 37 determines the need for an open or closed command signal via conductor 39 to the vacuum control valve 22. If consistency is below expectations designated by the set-point value, vacuum control valve 22 may be opened by a predetermined percentage of control range depending on the magnitude of consistency departure from the set point. Conversely, if consistency is above set-point expectations, commands are emitted to close the vacuum control valve 22.

It will be understood by those of ordinary skill in the art that the foregoing description of our invention represents only a singular control strategy useful for carrying out the invention purpose and objectives.

As our invention, we claim:

1. A method of improving an effectiveness of a top forming roll disposed transversely across and above a paper machine web forming section length such that said roll engages a traveling top surface of an aqueous stock pond carried along a machine direction by a forming wire at a point on said forming section length downstream of a suction box disposed transversely across and below said forming wire, said method comprising the steps of:

measuring a total combined mass flow rate of said aqueous stock pond and said forming wire at a point along said forming section length between said suction box and said top forming roll;

generating a first signal which is proportional to said combined mass flow rate;

generating a second signal which is proportional to a mass flow rate of only said forming wire;

combining said first and second signals to yield a third signal which is indicative of only a mass flow rate of said stock pond;

generating a fourth signal which is proportional to a mass flow rate of a dry fiber constituent within said stock pond;

combining said third signal with said fourth signal to yield a fifth signal which is proportional to a consistency of said stock pond at said point along substantially along said forming section length between said suction box and said top forming roll where said combined mass flow rate is measured;

generating a reference signal from said suction box;

combining said fifth signal with said reference signal to yield a vacuum regulation signal; and, adjusting, when necessary, a vacuum within said suction box in response to said vacuum regulation signal in order to control said consistency of said stock pond to a desired consistency, as said stock pond is carried into top surface contact with said top forming roll.

2. The method as described by claim 1 wherein said total combined mass flow rate is measured by a magnitude of photon energy back-scattered from gamma radiation incidence against said forming wire and said aqueous stock pond.

3. The method as described by claim 1 wherein said second signal is a constant value reduction of said first signal.

4. The method, as described by claim 1, wherein said fourth signal is a constant value proportional to an average dry fiber constituent of said stock pond.

5. The method as described by claim 1 wherein said fourth signal is a variable value proportional to a continuing measure of paper basis weight produced from said aqueous stock pond.

* * * * *